US008475338B2

(12) United States Patent
Greenhill et al.

(10) Patent No.: US 8,475,338 B2
(45) Date of Patent: Jul. 2, 2013

(54) LINEAR MOTOR SYSTEM FOR AN EXERCISE MACHINE

(75) Inventors: Michael Greenhill, Highland Park, IL (US); Mark Greenhill, Winnetka, IL (US); Brad Hill, Glenview, IL (US)

(73) Assignee: Smalley Steel Ring Company, Lake Zurich, IL (US)

( * ) Notice: Subject to any disclaimer, the term of this patent is extended or adjusted under 35 U.S.C. 154(b) by 395 days.

(21) Appl. No.: 12/774,857

(22) Filed: May 6, 2010

(65) Prior Publication Data

US 2011/0275481 A1 Nov. 10, 2011

(51) Int. Cl.
*A63B 24/00* (2006.01)

(52) U.S. Cl.
USPC ..... 482/5; 482/1; 482/8; 482/9; 482/901

(58) Field of Classification Search
USPC ..... 482/1–9, 900–902
See application file for complete search history.

(56) References Cited

U.S. PATENT DOCUMENTS

| | | | | |
|---|---|---|---|---|
| 4,828,257 | A | 5/1989 | Dyer et al. | |
| 4,907,797 | A * | 3/1990 | Gezari et al. | 482/9 |
| 4,930,770 | A | 6/1990 | Baker | |
| 4,934,694 | A * | 6/1990 | McIntosh | 482/9 |
| 5,015,926 | A | 5/1991 | Casler | |
| 5,020,794 | A | 6/1991 | Englehardt et al. | |
| 5,117,170 | A | 5/1992 | Keane et al. | |
| 5,762,584 | A | 6/1998 | Daniels | |
| 5,993,356 | A | 11/1999 | Houston et al. | |
| 6,224,519 | B1 | 5/2001 | Doolittle | |
| 6,368,251 | B1 | 4/2002 | Casler et al. | |
| 6,796,926 | B2 * | 9/2004 | Reinkensmeyer et al. | 482/8 |
| 6,852,068 | B2 * | 2/2005 | Ogawa | 482/8 |
| 7,854,685 | B2 * | 12/2010 | Cole et al. | 482/5 |
| 2005/0176560 | A1 | 8/2005 | Chen | |
| 2008/0161170 | A1 | 7/2008 | Lumpee | |
| 2009/0009110 | A1 | 1/2009 | Wang | |
| 2009/0258758 | A1 | 10/2009 | Hickman et al. | |
| 2010/0216600 | A1 * | 8/2010 | Noffsinger et al. | 482/5 |
| 2011/0306467 | A1 * | 12/2011 | Massa | 482/5 |

FOREIGN PATENT DOCUMENTS

GB 2 157 578 A 10/1985

OTHER PUBLICATIONS

PCT International Search Report for International Application No. PCT/US2011/035505 (date of actual completion of international search: Jul. 28, 2011).

* cited by examiner

*Primary Examiner* — Glenn Richman
(74) *Attorney, Agent, or Firm* — R. Blake Johnson, Esq.; DLA Piper LLP (US)

(57) ABSTRACT

Exercise machines and linear motor systems for use in exercise machines are provided herein, where the linear motor provides a resistance force in response to a force generated by a user performing an exercise. The linear motor systems include a programmable logic and force generation control system, which is programmable to control the resistance provided by the linear motor.

18 Claims, 7 Drawing Sheets

LINEAR MOTOR SYSTEM FOR AN EXERCISE MACHINE

BACKGROUND

The present technology relates to an exercise machine that utilizes a linear motor to provide resistance to a force generated by a user performing an exercise, and to linear motor systems for use in such exercise machines.

Typical physical fitness training equipment utilizes a weight stack sliding on vertical rods under the influence of gravity as the force producing element. Movement of the weight stack by the user is caused by tension created in a cable that attaches to the top of the weight stack. The weight stack, and more specifically gravity acting on the weight stack, is the force producing element that provides resistance to a pulling force generated by the user during an exercise routine. The weight stack is movable vertically through a series of pulleys and levers utilizing hand grips, bars, or other types of user devices to perform an exercise by lifting the weight stack. For example, FIG. 1 illustrates a known example of an exercise machine 100, with which a user can perform a number of exercises using a weight stack 114. The weight stack 114 slides along two parallel vertical rods 106 and 108 when the user of the exercise machine 100 pulls on the cable 120 during the course of performing an exercise routine. The vertical rods 106 and 108 are secured to the exercise machine 100 by a bottom weight support rod bracket 116 and a top weight support rod bracket 104. An attachment bolt 102 is used to secure the top weight support rod bracket 104 to the frame of the exercise machine 100. The cable 120 is connected at one end to a cable attachment bolt 110 which serves to secure the cable 120 to a weight support assembly 118 which is part of the weight stack 114. A weight selection pin 112 may be inserted into one of a plurality of holes in the weight stack 114, in order to select the amount of weight in the stack which will be moved during the performance of the exercise routine by the user. The other end of the cable 120, after passing through various pulleys, may be connected to various attachments (not shown) for use in performing the selected exercise, all in a known manner.

Other non-electronic weight lifting systems have also been utilized by designers of weight lifting equipment that offer variable resistance or fixed weight. In one example, large rubber bands have been utilized to produce resistance. In another example, hydraulic and/or pneumatic cylinders have been designed into weight lifting machines to produce resistance. Multiple weight stacks have also been incorporated into weight lifting equipment whereby additional weight can be added in a routine as the routine progressed by having the first weight stack come in contact with a secondary weight stack as the exercise progresses, adding predetermined weight during the routine.

BRIEF SUMMARY

The linear motor systems and exercise machines disclosed herein utilize a linear motor to provide resistance to a force generated by a user performing an exercise.

In one aspect.

BRIEF DESCRIPTION OF SEVERAL VIEWS OF THE DRAWINGS

Specific examples have been chosen for purposes of illustration and description, and are shown in the accompanying drawings, forming a part of the specification.

DETAILED DESCRIPTION

Figure 1:
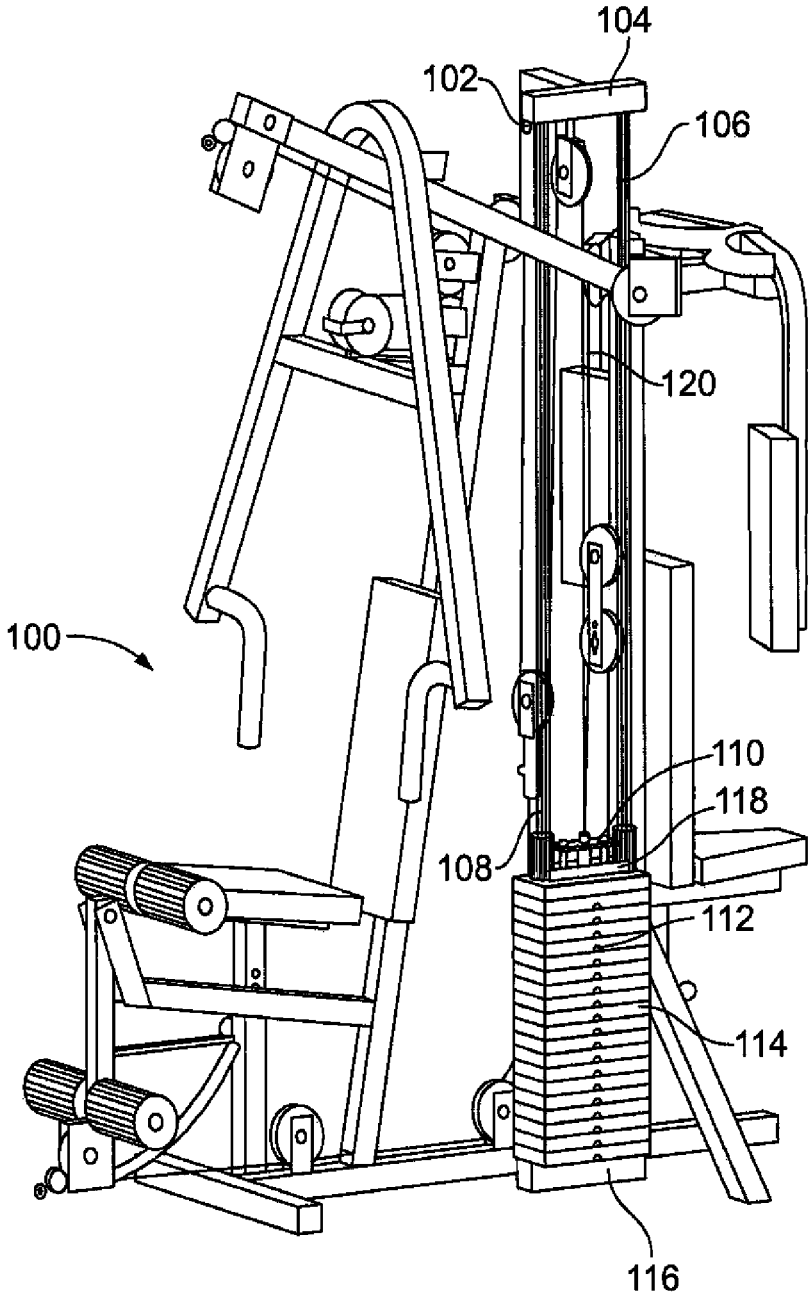
FIG. 1 Prior Art
FIG. 1 illustrates an exercise machine of the prior art that includes a weight stack.
Figure 2:
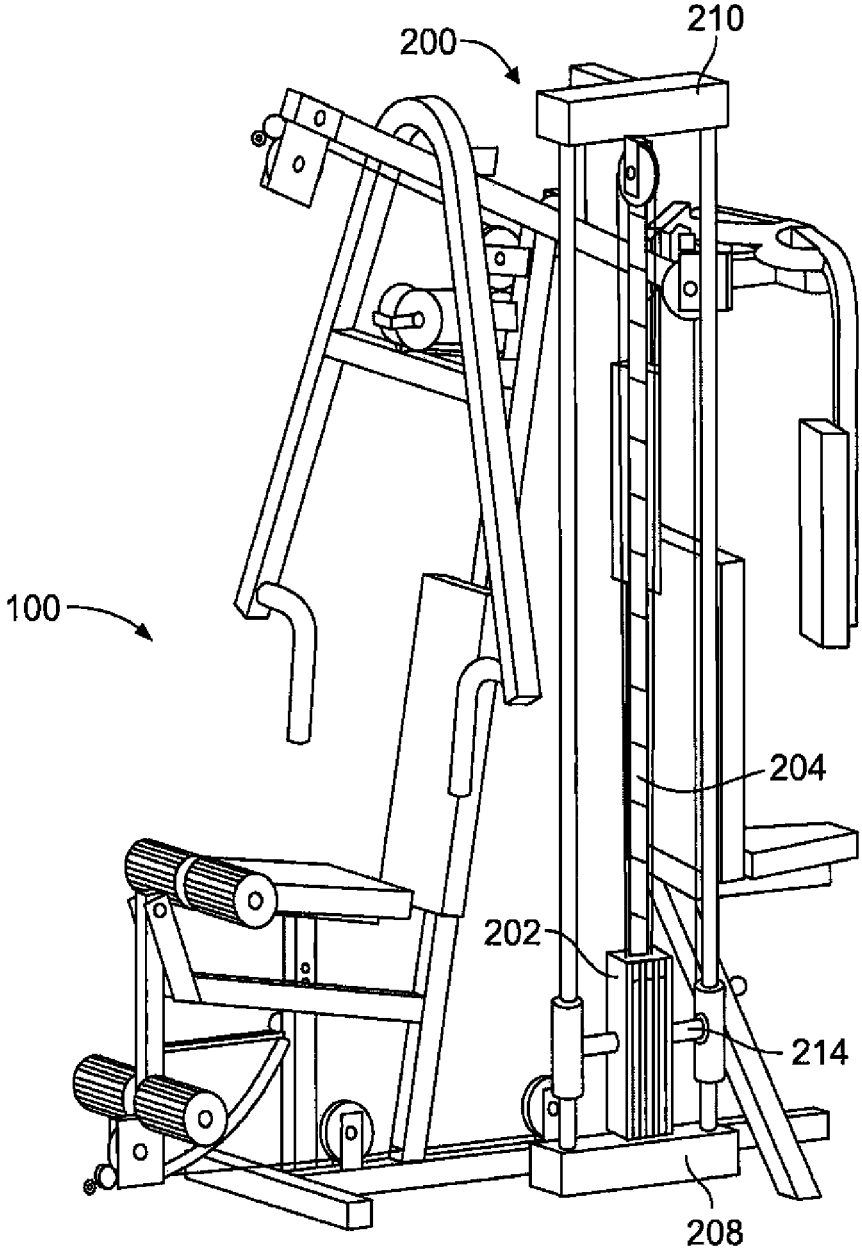
FIG. 2 illustrates one example of an exercise machine of the present technology, having a linear motor system.
Figure 3:
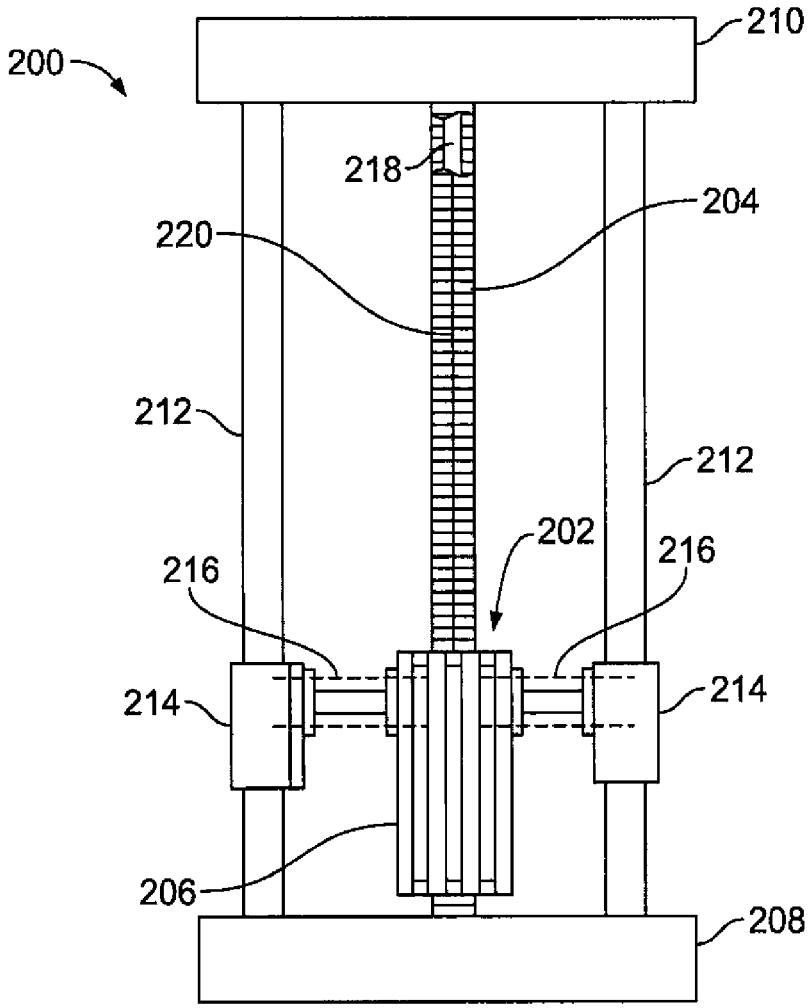
FIG. 3 illustrates a front view the linear motor and linear motor support structure of the example of FIG. 2.
Figure 4:
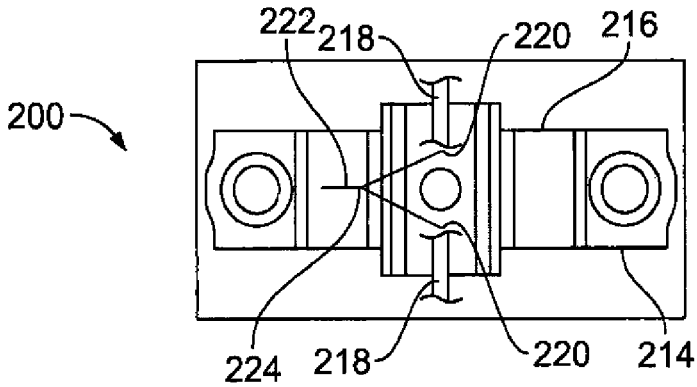
FIG. 4 illustrates a top view of the linear motor and linear motor support structure of the example of FIGS. 2 and 3.

The apparatus and system disclosed herein provides a replacement for the dead weight stack in any type of weight lifting equipment. Specifically, weight lifting equipment is disclosed herein that includes a linear motor system instead of a weight stack. The linear motor system includes a linear motor that acts as a force producing element to provide resistance to a force generated by a user when performing an exercise during an exercise routine. Exercise machines that incorporate linear motor systems of the present technology can be utilized in activities including, but not limited to, muscle building, strength training, endurance training, rehabilitation, and any other physical fitness application. For example, FIG. 2 illustrates an exercise machine 100 that is similar to the exercise machine of FIG. 1, but in which a linear motor system 200 of the present technology has been utilized instead of a weight stack. It should be noted that although only one linear motor is illustrated in FIG. 2, alternative exercise machines of the present technology can utilize two or more linear motors.

Linear motors as utilized herein generally include two magnetic fields that interact to induce or produce a force vector. The first magnetic field can be stationary, and the second magnetic field can move linearly along a path of travel defined by the first magnetic field. For example, referring to FIGS. 2 through 5, the linear motor system 200 includes a linear motor 202 that has a magnetic shaft 204 and a forcer 206 that can be moved along the magnetic shaft 204 in response to a force generated by a user during an exercise routine. The magnetic shaft 204 produces the first magnetic field, and can include a plurality of permanent magnets that are spaced along the path of travel. The plurality of permanent magnets are preferably equally spaced along the entire length of the path of travel. The forcer 206 produces the second magnetic field, which can be an electro-magnetic field. The forcer 206 includes a plurality of electric coils that are electrically isolated from one another, and that can be bonded together as a single unit. In some examples, the forcer 206 can include a plurality of groups of electric coils that are electrically connected together, and can be excited together, which can substantially increase the surface-area of electro-magnetic-to-magnetic field interaction, and subsequently the linear force which can be generated.

The electro-magnetic field produced by the forcer 206 can be variable with respect to magnitude, and can be switchable, meaning that it can be generated in any one or more of the electric coils contained within the forcer. A drive, such as a servo drive, can be utilized to control the magnitude of the electro-magnetic field magnitude and sequence the position of the electro-magnetic field between the coils in the forcer 206, in order to produce a linear force when the forcer 206 is in fixed proximity to the stationary magnetic field of the magnetic shaft 204. When the electro-magnetic field produced by the forcer 206 is de-energized, the linear motor 202 will not produce any linear force. Thus, when the forcer 206 is de-energized, the linear motor system 200 will not provide any resistance to the force generated by the user utilizing the exercise machine, other than the actual physical weight of the forcer 206, the bearings 214 and the brackets 216 that are discussed below.

A linear motor system 200 can also include a support structure for the linear motor 202 that has a base 208, a header support 210, and a pair of linear shafts 212 that extend from the base 208 to the header support 210. In the illustrated example, the base 208 and header support 210 can be horizontal, or substantially horizontal, and the linear shafts 212 can be vertical or substantially vertical. The linear shafts 212 are spaced apart, and are preferably parallel or substantially parallel. The linear shafts 212 can be connected to the base 208 and the header support 210 in any suitable manner. The linear shafts 212 can be made of any suitable material, and are preferably made of hardened steel.

The magnetic shaft 204 can be located between the linear shafts 212 and can extend from the base 208 to the header support 210. The magnetic shaft 204 can be connected to the base 208 and the header support 210 in any suitable manner. In the illustrated example, the magnetic shaft 204 can be vertical, or substantially vertical. The magnetic shaft 204 is preferably centrally located between the linear shafts 212, so that the distance between the center of the magnetic shaft and the center of either linear shaft 212 is equal or substantially equal.

The forcer 206 can be slidably connected to the linear shafts 212, and can be linearly displaced along the magnetic shaft 204 when a user applies force in performing an exercise. In the illustrated example, the forcer can be linearly displaced in a vertical direction, wherein the forcer 206 can start at a home position or lowered position when the user is in an initial position for performing the exercise, then rise vertically to a stroke displacement as the user reaches the full stroke of the exercise, and finally return to the home position as the user finishes the exercise by returning to the initial position.

The forcer 206 can be attached to bearings 214 by brackets 216, and the bearings 214 can be slidably attached to the linear shafts 212. The bearings 214 can slide up and down along the linear shafts 212, and preferably slide with little friction or essentially no friction. Referring to FIGS. 2 through 5, the forcer 206 can be mechanically connected to a handle 226, such as a bar or other type of grip, to which the user 228 applies force while performing an exercise, thus generating a pulling force on the forcer 206 of the linear motor 202. For example, two pulleys 218, one located on each side of the magnetic shaft 204, can be attached to the linear motor system 200 at or near the top of the magnetic shaft 204. Two cables 220 can be secured to the forcer 206, with one cable 220 being connected to the forcer 206 on each side of the of the magnetic shaft 204. The cables 220 can each engage one of the pulleys 218, and can connect to a single pulling cable 222 at a cable connecting point 224 located above the two pulleys 218. The pulling cable 222 can be operatively connected to the handle 226, and can engage one or more pulleys 230 that are intermediately located between the handle 226 and the connecting point 224. The cables 220 and 222 can be made of any suitable materials, and are preferably steel cables.

In some examples, mechanical adjustments can be incorporated to increase or decrease the force generated by the linear motor system 200. For example, a motor to user pulley size ratio of 1.5:1 within the exercise machine would increase the weight resistance out of the linear motor system 200 by 50% as compared to a motor to user pulley size ratio of 1:1. Conversely, a motor to user pulley size ratio of 1:1.5 within the exercise machine would decrease the weight resistance of the linear motor system 200 by 50% as compared to a motor to user pulley size ratio of 1:1.

Figure 5:
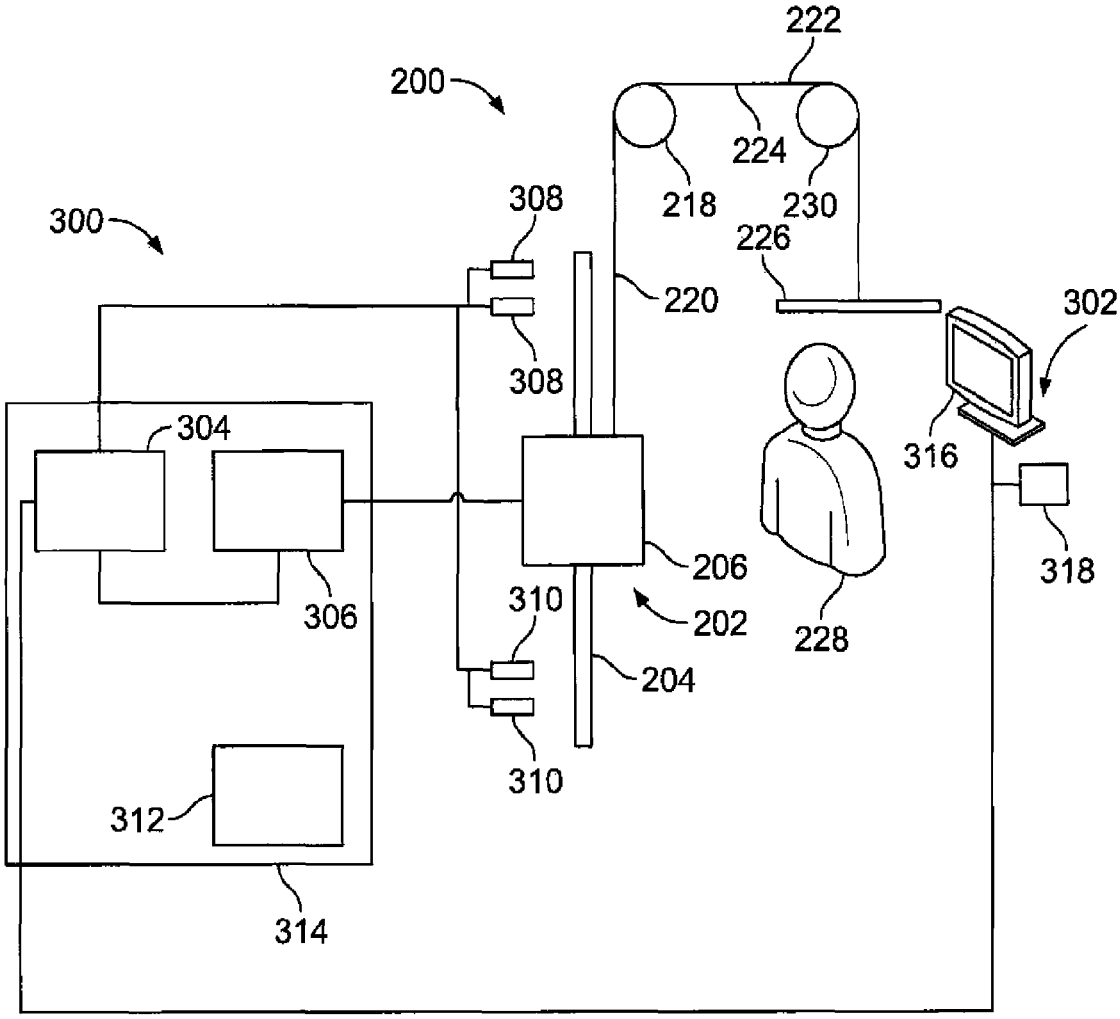
FIG. 5 illustrates a diagram of a control system for the exercise machine of FIGS. 2-4.

Referring to FIG. 5, the linear motor system 200 can include a programmable logic and force generation control system 300 that is operatively connected to the linear motor 202 and to a user interface 302. The programmable logic and force generation control system 300 can determine the state of the system by measuring the force, velocity, linear displacement, and direction of linear actuation, during the exercise routine. As shown in FIG. 5, the programmable logic and force generation control system 300 can include a user interface 302 operatively connected to a microprocessor 304 that is programmable to control the resistance provided by the linear motor 202, a servo amplifier 306 operatively connected to the microprocessor 304 and the forcer 206, one or more positive limit sensors 308 operatively connected to the microprocessor 304, one or more negative limit sensors 310 operatively connected to the microprocessor 304, and a power supply 312 that can provide power to any components of the exercise machine 200 as necessary. As illustrated in FIG. 5, the microprocessor 304, servo amplifier 306 and power supply 312 can be housed in a control panel 314.

The microprocessor 304 can receive data from the servo amplifier 306, the user interface 302, the one or more positive limit sensors 308, and the one or more negative limit sensors 310. The servo amplifier 306 can receive data from and send data to both the microprocessor 304 and the forcer 206, and can control the linear position and velocity of the forcer 206. The microprocessor 304 can execute a program that includes a set of instructions that enable the microprocessor to acquire data, compare values, and execute operations. For example, the microprocessor 304 can acquire data such as the position of the forcer 206 along the magnetic shaft 204, and the current. Microprocessor 304 can compare the acquired data to values that are calculated or user-defined, and can execute corrective actions to command and control both the magnitude and position of the electro-magnetic field produced by the forcer 206, and hence the force generation of the linear motor 202. In this manner, the microprocessor 304 can control the magnitude of the electromagnetic field, with respect to the position of the forcer 206, in order to increase, decrease, or maintain as constant the linear force generated by the interaction of the two magnetic fields.

The one or more positive limit sensors 308, and the one or more negative limit sensors 310 can be positioned to detect the presence of the forcer 206 at locations at or near the endpoints of the magnetic shaft 204. When the presence of the forcer 206 is detected by any of the positive or negative limit sensors 308 and 310, the sensor can send a signal to the microprocessor 304 indicating the presence of the forcer, and the microprocessor 304 can send appropriate command data to control the position of the forcer 206. In one preferred example, each of the one or more positive limit sensors 308 and the one or more negative limit sensors 310 the linear position feedback sensor can have a 25 micron resolution and can be analog in nature, allowing the sensor to continuously supply data as quickly as the microprocessor 304 can sample data.

The user interface 302 of the of the programmable logic and force generation control system 300 can be operatively connected to the microprocessor in any suitable manner, including, but not limited to an ethernet connection or a wired connection. The user interface 302 can include any suitable graphical user interface 316, and can also include an interactive interface 318 configured to allow the user to input data to program an exercise routine. The interactive interface 318 can be separate from or incorporated into the graphical user interface 316, and can, for example, include at least one of a touch screen, a keypad, or a data transfer link to input the data. In examples utilizing a touch screen and/or a keypad, the user can directly input the data to program an exercise routine. In examples utilizing a data transfer link, the user can transfer data from a computer readable storage medium in order to program the programmable logic and force generation control system 300. Examples of suitable data transfer links include, but are not limited to, wireless connections, as well as parallel ports or serial ports. In one example, an interactive interface 318 can include a USB port, and a user can transfer an exercise routine program to the programmable logic and force generation control system 300 from a USB flash memory stick. In other examples, a user can transfer data programmable logic and force generation control system 300 from a personal computer or from a handheld computing device such as an iPod™.

Utilization of the programmable logic and force generation control system 300 can allow the linear motor system 200 to be programmable to provide resistance in both positive and negative directions during an exercise cycle. The positive direction is the direction of the exercise stroke, which is the first half of the exercise cycle as the user goes from an initial position to a stroke position such as, for example, an extended position. The negative direction is the direction of the return, which is the second half of the exercise cycle in which the user returns to the original position ready to begin another stroke. Further, the utilization of the programmable logic and force generation control system 300 can allow the linear motor system 200 to be infinitely programmable to permit the user to define his or her own weight lifting routine in simple or complex curves.

Figure 6:
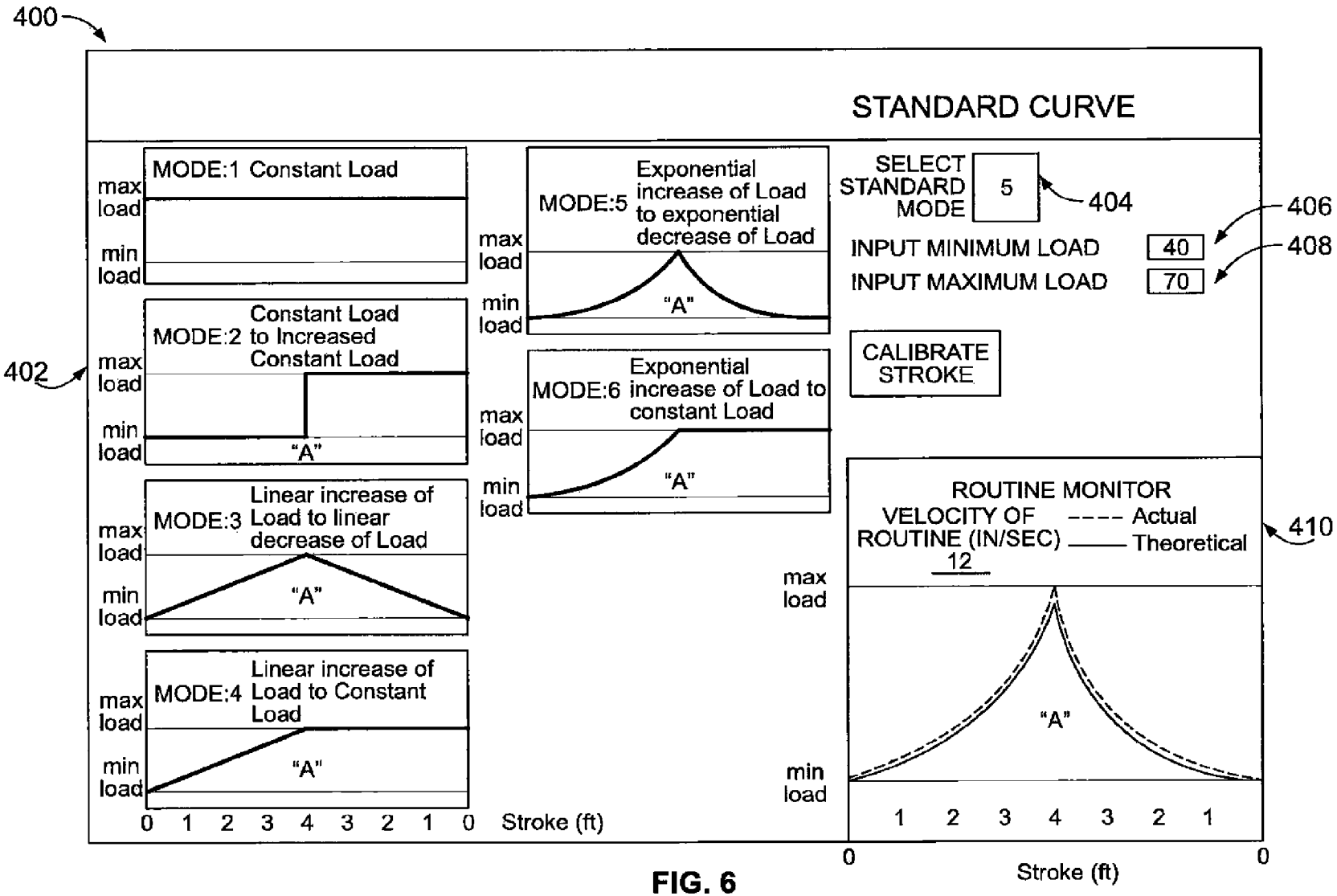
FIG. 6 illustrates one example of a user interface for an exercise machine of FIGS. 2-4, in which the user can select a standard curve to control the exercise routine.

FIG. 6 illustrates one example of a screen display 400 for the user interface of a programmable logic and force generation control system 300 of the present technology, which provides a visual selection 402 of standard exercise routine curves and permits a user to select an exercise routine curve at a first indicator location 404, as well as permitting the user to enter a minimum load value at a second indicator location 406 and a maximum load value at a third indicator location 408, prior to beginning the exercise routine. A standard exercise routine curve can be a curve that is pre-programmed and stored in the programmable logic and force generation control system 300. When a standard exercise routine curve is selected by the user, it can be utilized by the programmable logic and force generation control system 300 to control the amount of resistance, or the load, that will be produced by the linear motor system 200 during each stroke of the exercise routine. The exercise routine curve selected by the user can be as simple as straight line, as shown in Mode 1, which provides a pre-specified constant force in both the positive direction and the negative direction. Alternatively, the exercise routine curve can provide as many resistive load changes as desired within a single stroke of the exercise machine. Some examples of such exercise routine curves are illustrated in Modes 2 through 6 of FIG. 6. The screen display 400 can also include a routine monitor 410 that displays information measured by the programmable logic and force generation control system 300 during performance of the exercise routine by the user.

Figure 7:
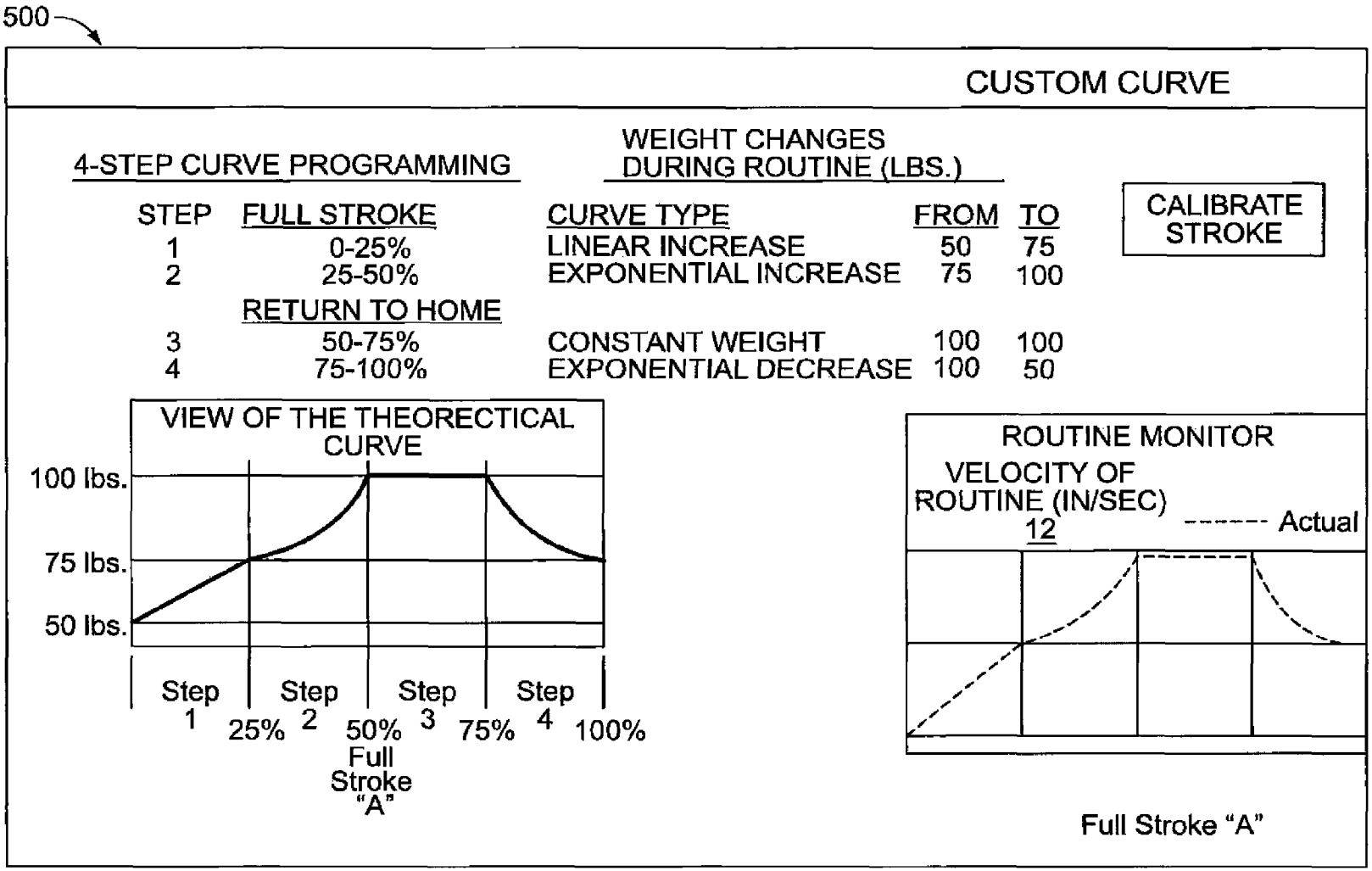
FIG. 7 illustrates one example of a user interface for an exercise machine of FIGS. 2-4, in which the user can input a custom curve to control the exercise routine.

FIG. 7 illustrates an example of a screen display 500 for the user interface of a programmable logic and force generation control system 300 of the present technology, which provides a visual display of a custom exercise routine curve that can be entered by a user. The illustrated custom curve includes a plurality of programmable regions to provide the user with the ability to pre-define the weight, velocity and/or direction of the exercise routine. As illustrated, the custom curve can be setup to divide the motion of the exercise into four distinct (4) regions; two (2) regions for the first half of the motion, such as the full stroke or extension, and two (2) regions for the second half of the motion, such as the return stroke back to the original position. Each region of the custom curve can be defined according to user defined parameters including the amount of weight, the amount of weight change, and the type of weight change. Types of weight change that can be selected include, for example, constant weight, linear increase, exponential increase, linear decrease, and exponential decrease.

In practice, the exercise machine can be calibrated prior to the start of any exercise routine. During calibration the programmable logic and force generation control system can monitor and learn the amount of linear displacement necessary for a given individual or exercise. In order to calibrate the system for a particular routine, the user would initiate a calibration mode by selecting that mode at the user interface, such as by pressing the "Calibrate Stroke" box on the touch screen display of FIG. 6 or FIG. 7. In the calibration mode, the linear motor would apply a very low resistance force. The user can assume an initial position for the exercise, grip the handle or bar of the exercise machine, and then perform the desired motion for the full stroke of the exercise, which is half or 50% of the full motion for the exercise. Performance of the stroke of the exercise can result in a displacement of the linear motor along it's length of travel, starting at a home position when the user is in the initial position for the exercise and moving to a stroke displacement when the user performs the stroke of the exercise. The programmable logic and force generation control system can monitor and record the position of the linear motor, and can record the stroke displacement, which is the maximum distance of travel for the linear motor during the given exercise. Assuming that the user performs the stroke of the exercise in a similar manner each time, as should be done for proper form, then the stroke displacement is a turn-around point for the linear motor. In one example, the stroke displacement can be identified and noted by the programmable logic and force generation control system as being the point at which the displacement of the linear motor remains unchanged for 1 second. The user would then reverse the motion of the stroke for the exercise, returning to the initial position, and thus returning the linear motor to home position, simulating a complete exercise cycle. Once the stroke displacement has been identified by the programmable logic and force generation control system, the programmable logic and force generation control system can apply the resistance profile selected by the user across the correct linear distance. For example, stroke displacement in the example of FIG. 6 was identified as being 4 feet during calibration. Accordingly, the routine monitor 410 in FIG. 6 shows a full stroke distance of 4 feet at point "A."

Figure 8:
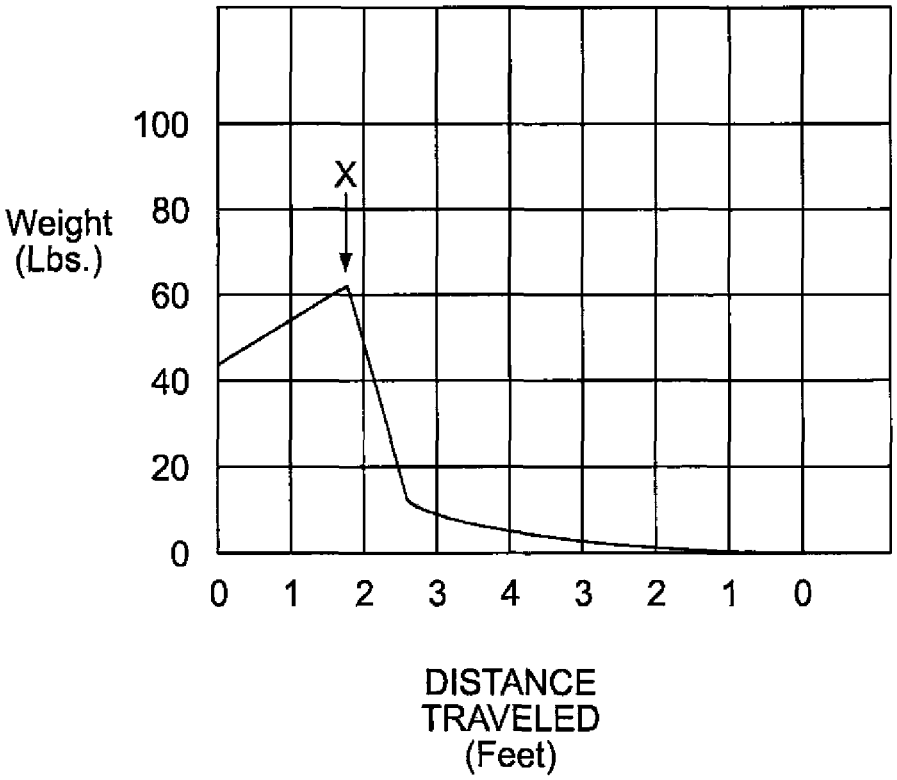
FIG. 8 illustrates a force versus distance graph of the operation of the exercise machine of FIG. 2 in a fail safe mode.

Exercise machines of the present technology can include a safety setting, or fail safe mode of operation, that can operate if the programmable logic and force generation control system detects a no load situation. A no load situation can be detected when there is a load change or velocity change, such as a high linear acceleration or no resistance, as would happen in instances where a user lets go of the handle. FIG. 8 illustrates a graph of the amount of weight versus the distance traveled for a fail safe mode of operation. As illustrated, the user begins the exercise and lets go of the handle at point "X," which is at less than 25% of the complete cycle and a resistance force of 61 pounds. The programmable logic and force generation control system detects the no load situation and begins a reverse mode, wherein it rapidly reduces the resistive force of the linear motor from 61 pounds to about 10 pounds, and then gradually tapers the amount of weight down to zero as the position of the linear motor returns to home position. The fail safe mode can be operated to prevent anyone from getting injured during an exercise routine.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. An exercise machine that comprises:

a linear motor system having a linear motor including:

a base;

a header support;

a pair of linear shafts that extend from the base to the header support and a magnetic shaft being located between the linear shafts and extending from the base to the header support;

a forcer slidably attached to the linear shafts that moves along the magnetic shaft, wherein the linear motor acts as a force producing element to provide resistance to a force generated by a user when performing an exercise.

2. The exercise machine of claim 1, wherein the resistance provided by the linear motor can be varied in increments of about 0.5 pounds or greater.

3. The exercise machine of claim 1, wherein the resistance provided by the linear motor can be provided in a positive direction or a negative direction.

4. The exercise machine of claim 1, wherein the linear motor is a servo motor.

5. The exercise machine of claim 1, wherein the forcer is mechanically connected to a handle to which the user applies force while performing the exercise.

6. The exercise machine of claim 5, wherein the forcer is connected to the handle by cables and pulleys.

7. An exercise machine that comprises:

a linear motor system having a linear motor including a forcer that moves along a magnetic shaft, wherein the linear motor acts as a force producing element to provide resistance to a force generated by a user when performing an exercise, the linear motor system further including a programmable logic and force generation control system operatively connected to the linear motor system, the programmable logic and force generation control system comprising a microprocessor that is programmable to control the resistance provided by the linear motor.

8. An exercise machine that comprises:

a linear motor system having a linear motor including a forcer that moves along the a magnetic shaft, wherein the linear motor acts as a force producing element to provide resistance to a force generated by a user when performing an exercise, where the forcer is linearly displaced in response to the force generated by the user when performing an exercise and starts at a home position when the user is in an initial position for performing the exercise, rises vertically to a stroke displacement as the user reaches a full stroke of the exercise, and returns to the home position as the user finishes the exercise by returning to the initial position.

9. A linear motor system for producing a resistance force in an exercise machine in response to a force generated by a user when performing an exercise, the linear motor system comprising:

a base;

a header support;

a pair of linear shafts that extend from the base to the header support;

a magnetic shaft located between the linear shafts and extending from the base to the header support; and a forcer slidably attached to the linear shafts that moves along the magnetic shaft to produce the resistance force.

10. The linear motor system of claim 9, wherein the linear motor system further comprises a programmable logic and force generation control system operatively connected to the linear motor system, the programmable logic and force generation control system comprising a microprocessor that is programmable to control the resistance provided by the linear motor.

11. The linear motor system of claim 9, wherein the programmable logic and force generation control system farther comprises;

a user interface; and a linear position feedback sensor to allow control of the linear position and velocity of the forcer.

12. The linear motor system of claim 11, wherein the user interface comprises graphical user interface.

13. The linear motor system of claim 11, wherein the user interface comprises an interactive interface configured to allow the user to input data to program an exercise routine.

14. The linear motor system of claim 13, wherein the interactive interface comprises at last one of a touch screen, a keypad, or a data transfer link.

15. The exercise machine of claim 9, wherein the resistance force provided by the linear motor can be provided in a positive direction or a negative direction.

16. The exercise machine of claim 9, wherein the linear motor is a servo motor.

17. The exercise machine of claim 9, wherein the forcer starts at a home position when the user is in an initial position for performing the exercise, rises vertically to a stroke displacement as the user reaches a full stroke of the exercise, and returns to the home position as the user finishes the exercise by returning to the initial position.

18. A linear motor system for producing a resistance force in an exercise machine in response to a force generated by a user when performing an exercise, the linear motor system comprising:

a base;

a header support;

a pair of linear shafts that extend from the base to the header support;

a magnetic shaft located between the linear shafts and extending from the base to the header support;

a forcer slidably attached to the linear shafts that moves along the magnetic shaft to produce the resistance force; and a programmable logic and force generation control system operatively connected to the linear motor system, the programmable logic and force generation control system comprising a microprocessor that is programmable to control the resistance provided by the linear motor.

* * * * *